US009200225B2

(12) United States Patent
Barkdoll et al.

(10) Patent No.: US 9,200,225 B2
(45) Date of Patent: Dec. 1, 2015

(54) METHOD AND APPARATUS FOR COMPACTING COAL FOR A COAL COKING PROCESS

(75) Inventors: Michael P. Barkdoll, Knoxville, TN (US); John Sanor, Salem, OH (US); Richard C. Retort, Edinburg, PA (US)

(73) Assignee: SunCoke Technology and Development LLC., Lisle, IL (US)

( * ) Notice: Subject to any disclaimer, the term of this patent is extended or adjusted under 35 U.S.C. 154(b) by 746 days.

(21) Appl. No.: 12/849,192

(22) Filed: Aug. 3, 2010

(65) Prior Publication Data

US 2012/0030998 A1 Feb. 9, 2012

(51) Int. Cl.

| | |
|---|---|
| ***C10B 35/00*** | (2006.01) |
| ***C10L 5/02*** | (2006.01) |
| ***C10L 5/04*** | (2006.01) |
| ***C10B 31/10*** | (2006.01) |
| ***C10B 45/02*** | (2006.01) |
| ***C10L 5/06*** | (2006.01) |
| ***C10L 5/36*** | (2006.01) |

(52) U.S. Cl.

CPC . *C10L 5/04* (2013.01); *C10B 31/10* (2013.01); *C10B 45/02* (2013.01); *C10L 5/06* (2013.01); *C10L 5/361* (2013.01)

(58) Field of Classification Search

CPC ..... C10B 31/10; C10B 45/02; C10L 5/04; C10L 5/06; C10L 5/361; F01K 3/21

USPC ..... 201/8, 13, 40; 202/248, 262, 270; 432/121, 239; 44/491

See application file for complete search history.

(56) References Cited

U.S. PATENT DOCUMENTS

| | | | |
|---|---|---|---|
| 469,868 | A | 3/1892 | Thomas et al. |
| 1,140,798 | A | 5/1915 | Carpenter |
| 1,424,777 | A | 8/1922 | Schondeling |

(Continued)

FOREIGN PATENT DOCUMENTS

| | | |
|---|---|---|
| CA | 2775992 A1 | 5/2011 |
| CA | 2822857 | 7/2012 |

(Continued)

OTHER PUBLICATIONS

JP 03-197588, Inoqu Keizo et al., Method and Equipment for Boring Degassing Hole in Coal Charge in Coke Oven, Japanese Patent (Abstract Only) Aug. 28, 1991.

(Continued)

*Primary Examiner* — James Goloboy
*Assistant Examiner* — Latosha Hines
(74) *Attorney, Agent, or Firm* — Perkins Coie LLP

(57) ABSTRACT

Relatively high speed methods for increasing the bulk density of coal particles without impacting the coal particles and an apparatus for compacting coal for making metallurgical coke. The method includes depositing coal particles onto a charging plate external to a coking oven. The charging plate has side walls, and at least one movable end wall to provide an elongate bed of dry, uncompacted coal having an upper surface on the charging plate. The uncompacted coal is compacted by passing a vibratory cylindrical compactor along a length of the uncompacted coal for a number of passes sufficient to decrease a thickness of the bed of coal to less than about 80 percent of an original thickness of the uncompacted coal. The vibratory cylindrical compactor has a length to diameter ratio ranging from about 1.4:1 to about 2:1.

15 Claims, 13 Drawing Sheets

(56) References Cited

U.S. PATENT DOCUMENTS 1,430,027 A 9/1922 Plantinga
1,486,401 A 3/1924 Van Ackeren
1,572,391 A 2/1926 Klaiber
1,721,813 A 7/1929 Rudolf et al.
1,818,370 A 8/1931 Wine
1,848,818 A 3/1932 Becker
1,955,962 A 4/1934 Jones
2,394,173 A 2/1946 Harris et al.
2,424,012 A 7/1947 Bangham et al.
2,902,991 A 9/1959 Whitman
3,033,764 A 5/1962 Hannes
3,462,345 A 8/1969 Kernan
3,545,470 A 12/1970 Paton
3,616,408 A 10/1971 Hickam
3,630,852 A 12/1971 Nashan et al.
3,652,403 A 3/1972 Knappstein et al.
3,676,305 A 7/1972 Cremer
3,709,794 A 1/1973 Kinzler et al.
3,746,626 A 7/1973 Morrison, Jr.
3,748,235 A 7/1973 Pries
3,784,034 A 1/1974 Thompson
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Dix et al.
3,878,053 A 4/1975 Hyde
3,897,312 A 7/1975 Armour et al.
3,906,992 A 9/1975 Leach
3,912,091 A 10/1975 Thompson
3,917,458 A 11/1975 Polak
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach
3,984,289 A 10/1976 Sustarsic et al.
4,004,702 A 1/1977 Szendroi
4,004,983 A 1/1977 Pries
4,040,910 A 8/1977 Knappstein et al.
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,189,272 A 2/1980 Gregor et al.
4,194,951 A 3/1980 Pries
4,196,053 A 4/1980 Grohmann
4,211,608 A 7/1980 Kwasnoski et al.
4,213,489 A 7/1980 Cain
4,213,828 A 7/1980 Calderon
4,222,748 A 9/1980 Argo et al.
4,225,393 A 9/1980 Gregor et al.
4,235,830 A 11/1980 Bennett et al.
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,498,786 A 2/1985 Ruscheweyh
4,508,539 A 4/1985 Nakai
4,527,488 A 7/1985 Lindgren
4,568,426 A 2/1986 Orlando et al.
4,570,670 A 2/1986 Johnson
4,614,567 A 9/1986 Stahlherm et al.
4,645,513 A 2/1987 Kubota et al.
4,655,193 A 4/1987 Blacket
4,655,804 A 4/1987 Kercheval et al.
4,680,167 A 7/1987 Orlando et al.
4,704,195 A 11/1987 Janicka et al.
4,720,262 A 1/1988 Durr et al.
4,726,465 A 2/1988 Kwasnik et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,114,542 A 5/1992 Childress et al.
5,227,106 A 7/1993 Kolvek
5,228,955 A 7/1993 Westbrook, III
5,318,671 A 6/1994 Pruitt
5,670,025 A 9/1997 Baird
5,928,476 A 7/1999 Daniels
5,968,320 A 10/1999 Sprague
6,017,214 A 1/2000 Sturgulewski
6,059,932 A * 5/2000 Sturgulewski ..... 202/262
6,139,692 A 10/2000 Tamura et al.
6,152,668 A 11/2000 Knoch
6,187,148 B1 2/2001 Sturgulewski
6,189,819 B1 2/2001 Racine
6,290,494 B1 * 9/2001 Barkdoll ..... 432/121
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
7,056,390 B2 6/2006 Fratello et al.
7,077,892 B2 7/2006 Lee
7,314,060 B2 1/2008 Chen et al.
7,331,298 B2 2/2008 Taylor et al.
7,611,609 B1 * 11/2009 Valia et al. ..... 201/5
7,644,711 B2 1/2010 Creel
7,727,307 B2 6/2010 Winkler
7,803,627 B2 9/2010 Hodges
7,827,689 B2 11/2010 Crane et al.
7,998,316 B2 8/2011 Barkdoll
8,071,060 B2 12/2011 Ukai et al.
8,079,751 B2 12/2011 Kapila et al.
8,236,142 B2 8/2012 Westbrook et al.
8,266,853 B2 9/2012 Bloom et al.
8,398,935 B2 3/2013 Howell, Jr. et al.
2006/0102420 A1 5/2006 Huber et al.
2007/0289861 A1 * 12/2007 Barkdoll et al. ..... 201/8
2008/0169578 A1 7/2008 Crane et al.
2008/0179165 A1 7/2008 Chen et al.
2008/0271985 A1 11/2008 Yamasaki
2009/0217576 A1 9/2009 Kim et al.
2009/0283395 A1 11/2009 Hippe
2010/0098521 A1 4/2010 Kartal et al.

(56) References Cited

U.S. PATENT DOCUMENTS

| | | | |
|---|---|---|---|
| 2010/0115912 | A1 | 5/2010 | Worley et al. |
| 2010/0287871 | A1 | 11/2010 | Bloom et al. |
| 2011/0048917 | A1 | 3/2011 | Kim et al. |
| 2011/0223088 | A1 | 9/2011 | Chang et al. |
| 2011/0253521 | A1 | 10/2011 | Kim |
| 2012/0024688 | A1 | 2/2012 | Barkdoll |
| 2012/0152720 | A1 | 6/2012 | Reichelt et al. |
| 2012/0228115 | A1 | 9/2012 | Westbrook |
| 2013/0216717 | A1 | 8/2013 | Rago et al. |
| 2013/0306462 | A1 | 11/2013 | Kim et al. |
| 2014/0033917 | A1 | 2/2014 | Rodgers et al. |
| 2014/0048402 | A1 | 2/2014 | Quanci et al. |
| 2014/0048404 | A1 | 2/2014 | Quanci et al. |
| 2014/0048405 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0247092 | A1 | 9/2015 | Quanci et al. |

FOREIGN PATENT DOCUMENTS

| | | | |
|---|---|---|---|
| CN | 2064363 | U | 10/1990 |
| CN | 1092457 | A | 9/1994 |
| CN | 1255528 | A | 6/2000 |
| CN | 1358822 | | 7/2002 |
| CN | 2509188 | | 9/2002 |
| CN | 2528771 | | 1/2003 |
| CN | 1468364 | A | 1/2004 |
| CN | 2668641 | Y | 1/2005 |
| CN | 202226816 | U | 5/2012 |
| DE | 212176 | C | 7/1909 |
| DE | 3315738 | A1 | 11/1983 |
| DE | 3329367 | C1 | 11/1984 |
| DE | 19545736 | A1 | 6/1997 |
| DE | 19803455 | C1 | 8/1999 |
| DE | 10154785 | A1 | 5/2003 |
| DE | 102009031436 | | 1/2011 |
| DE | 102011052785 | B3 | 12/2012 |
| FR | 2339664 | A1 | 8/1977 |
| GB | 441784 | | 1/1936 |
| GB | 606340 | A | 8/1948 |
| GB | 611524 | A | 11/1948 |
| GB | 725865 | A | 3/1955 |
| GB | 871094 | A | 6/1961 |
| JP | S50148405 | | 11/1975 |
| JP | 54054101 | A | 4/1979 |
| JP | 57051786 | A | 3/1982 |
| JP | 57051787 | A | 3/1982 |
| JP | 57083585 | A | 5/1982 |
| JP | 57090092 | | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | | 12/1987 |
| JP | 01103694 | A | 4/1989 |
| JP | 01249886 | A | 10/1989 |
| JP | H0319127 | | 1/1991 |
| JP | 03197588 | | 8/1991 |
| JP | 04159392 | | 6/1992 |
| JP | 07188668 | | 7/1995 |
| JP | 07216357 | | 8/1995 |
| JP | 08127778 | A | 5/1996 |
| JP | 2001200258 | A | 7/2001 |
| JP | 2002106941 | A | 4/2002 |
| JP | 200341258 | A | 2/2003 |
| JP | 2003071313 | A | 3/2003 |
| JP | 2009144121 | A | 7/2009 |
| JP | 2012102302 | A | 5/2012 |
| KR | 960008754 | Y1 | 10/1996 |
| KR | 1019990054426 | | 3/2000 |
| KR | 10-0797852 | | 1/2008 |
| KR | 10-2011-0010452 | A | 2/2011 |
| KR | 10-0296700 | B1 | 10/2011 |
| KR | 101318388 | B1 | 10/2013 |
| WO | WO-9012074 | A1 | 10/1990 |
| WO | WO-9945083 | A1 | 9/1999 |
| WO | WO-2007103649 | A2 | 9/2007 |
| WO | WO-2008034424 | A1 | 3/2008 |
| WO | WO-2010107513 | A1 | 9/2010 |
| WO | WO-2011000447 | A1 | 1/2011 |
| WO | WO-2012029979 | A1 | 3/2012 |
| WO | WO-2013023872 | A1 | 2/2013 |

OTHER PUBLICATIONS

JP 04-159392, Inoue Keizo et al., Method and Equipment for Opening Hole for Degassing of Coal Charge in Coke Oven, Japanese Patent (Abstract Only) Jun. 2, 1992.

International Search Report and Written Opinion of International Application No. PCT/US2011/046091; Date of Mailing: Dec. 16, 2011; 11 pages.

ASTM D5341-99(2010)e1, Standard Test Method for Measuring Coke Reactivity Index (CRI) and Coke Strength After Reaction (CSR), ASTM International, West Conshohocken, PA, 2010.

Chinese Office Action in Chinese Application No. 201180048122.2, Mailing Date Dec. 31, 2014, 5 pages.

Chinese Office Action in Chinese Application No. 201180048122.2, Mailing Date Mar. 21, 2014, 8 pages.

Chinese Office Action in Chinese Application No. 201180048122.2, Mailing Date Jun. 11, 2015, 3 pages.

Clean coke process: process development studies by USS Engineers and Consultants, Inc., Wisconsin Tech Search, request date Oct. 5, 2011, 17 pages.

Rose, Harold J., "The Selection of Coals for the Manufacture of Coke," American Institute of Mining and Metallurgical Engineers, Feb. 1926, 8 pages.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

Extended European Search Report in European Application No. 11815126.5; Date of Mailing Jul. 22, 2014, 6 pages.

U.S. Appl. No. 14/839,384, filed Aug. 28, 2015, Quanci et al.

U.S. Appl. No. 14/839,493, filed Aug. 28, 2015, Quanci et al.

U.S. Appl. No. 14/839,551, filed Aug. 28, 2015, Quanci et al.

U.S. Appl. No. 14/839,588, filed Aug. 28, 2015, Quanci et al.

U.S. Appl. No. 14/865,581, filed Sep. 25, 2015, Sarpen et al.

* cited by examiner

METHOD AND APPARATUS FOR COMPACTING COAL FOR A COAL COKING PROCESS

TECHNICAL FIELD

The disclosure relates to a method and apparatus for making coke from coal and in particular to an improved method and apparatus for compacting coal for feed to a non-recovery coking oven.

BACKGROUND AND SUMMARY

Coke is a solid carbon fuel and carbon source used to melt and reduce iron ore in the production of steel. During an iron-making process, iron ore, coke, heated air and limestone or other fluxes are fed into a blast furnace. The heated air causes combustion of the coke that provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores, as described above, is produced by batch feeding pulverized coal to an oven that is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused mass having a predetermined porosity and strength. Because the production of coke is a batch process, multiple coke ovens are operated simultaneously, hereinafter referred to as a "coke oven battery".

At the end of the coking cycle, the finished coke is removed from the oven and quenched with water. The cooled coke may be screened and loaded onto rail cars or trucks for shipment or later use or moved directly to an iron melting furnace.

The melting and fusion process undergone by the coal particles during the heating process is the most important part of the coking process. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens on a predetermined schedule, and the coal is heated for a predetermined period of time in the ovens in order to remove volatiles from the resulting coke. The coking process is highly dependent on the oven design, the type of coal and conversion temperature used. Ovens are adjusted during the coking process so that each charge of coal is coked out in approximately the same amount of time. Once the coal is coked out, the coke is removed from the oven and quenched with water to cool it below its ignition temperature. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type ovens, the coal is typically charged through slots or openings in the top of the ovens.

Such ovens tend to be tall and narrow. More recently, horizontal non-recovery or heat recovery type coking ovens have been used to produce coke. Horizontal ovens are described for example in U.S. Pat. Nos. 3,784,034 and 4,067,462 to Thompson. In the non-recovery or heat recovery type coking ovens, conveyors are used to convey the coal particles horizontally into the ovens to provide an elongate bed of coal having a height of about 101 centimeters, a length of about 13.7 meters, and a width of about 3.6 meters.

As the source of coal suitable for forming metallurgical coal has decreased, attempts have been made to blend weak or non-coking coals with coking coals to provide a suitable coal charge for the ovens. One attempt is to use compacted coal. The coal may be compacted before or after it is in the oven. While coal conveyors are suitable for charging ovens with particulate coal that is then partially compacted in the oven, such conveyors are generally not suitable for charging ovens with pre-compacted coal. Ideally, the coal should be compacted to greater than 800 kilograms per cubic meter in order to enhance the usefulness of lower quality coal. It is well known that as the percentage of lower quality coal in a coal blend is increased, higher levels of coal compaction are required up to about 1040 to 1120 kilograms per cubic meter.

However, currently available processes are not suitable for providing a compacted coal charge that has a substantially uniform bulk density throughout the entire depth of an elongate coal charge bed at a relatively high rate of speed and without the generation of substantial amounts of coal dust during compaction. There is a need therefor, for an improved method and apparatus for compacting coal without generating coal dust and for charging coking ovens with pre-compacted coal. There is also a need for an apparatus for minimizing the amount of time required to provide a substantially uniform bed of compacted coal for use in making metallurgical coke.

In accordance with the foregoing and other needs, the disclosure provides relatively high speed methods for increasing the bulk density of coal particles without impacting the coal particles and an apparatus for compacting coal for making metallurgical coke. The method includes depositing coal particles onto a charging plate external to a coking oven. The charging plate has side walls, and at least one movable end wall to provide an elongate bed of dry, uncompacted coal having an upper surface on the charging plate. The uncompacted coal is compacted by passing a vibratory cylindrical compactor along a length of the uncompacted coal for a number of passes sufficient to decrease a thickness of the bed of coal to less than about 80 percent of an original thickness of the uncompacted coal. The vibratory cylindrical compactor has a length to diameter ratio ranging from about 1.4:1 to about 2:1. In another aspect, an exemplary embodiment of the disclosure provides a coal compacting and coke oven charging apparatus. The apparatus has a coal bed transfer plate having side walls, at least one movable end wall, and a transfer plate translating mechanism for transporting compacted coal into the coke oven. A vacuum source is used for degassing the uncompacted bed of coal during the compaction process to provide a dry, compacted coal bed having a bulk density ranging from about 960 to about 1200 kilograms per cubic meter.

In yet another aspect, an exemplary embodiment of the disclosure provides a coal compacting and coke oven charging apparatus The apparatus includes a coal bed charge car comprising a transfer plate having side walls, at least one movable end wall, and a transfer plate translating mechanism for transporting compacted coal into the coke oven. A coal compacting device is provided to compact the coal without impact energy. The coal compacting device includes a vibratory roller mechanism for compacting a bed of uncompacted coal on the transfer plate; a coal bed translation device attached to the vibratory roller mechanism for moving the vibratory roller mechanism along a length of the bed of uncompacted coal; an elevation mechanism on the coal bed translation device for lowering the vibratory roller to be in contact with the uncompacted coal during a compacting step and for raising the vibratory roller out of contact with compacted coal during an oven charging step; and a degassing device for degassing the uncompacted bed of coal during the compacting step.

The method and apparatus described herein provide unique advantages for coking operations including providing coal with a relatively high bulk density in a relatively short period of time. Another advantage of the method and apparatus is that relatively simple mechanical devices may be used to compact the coal and transfer the compacted coal into the coke oven without using a pile-driver-type compaction device that may cause an increase in coal dust during compaction and that may cause damage to structures and equipment during the compaction process. A further advantage is that the resulting coal bed is substantially compacted throughout its depth to about the same uniform bulk density.

BRIEF DESCRIPTION OF THE DRAWINGS

Further advantages of the disclosed embodiments may be apparent by reference to the detailed description of exemplary embodiments when considered in conjunction with the drawings, which are not to scale, wherein like reference characters designate like or similar elements throughout the several drawings as follows.

DETAILED DESCRIPTION OF THE PREFERRED EMBODIMENTS

Figure 1:
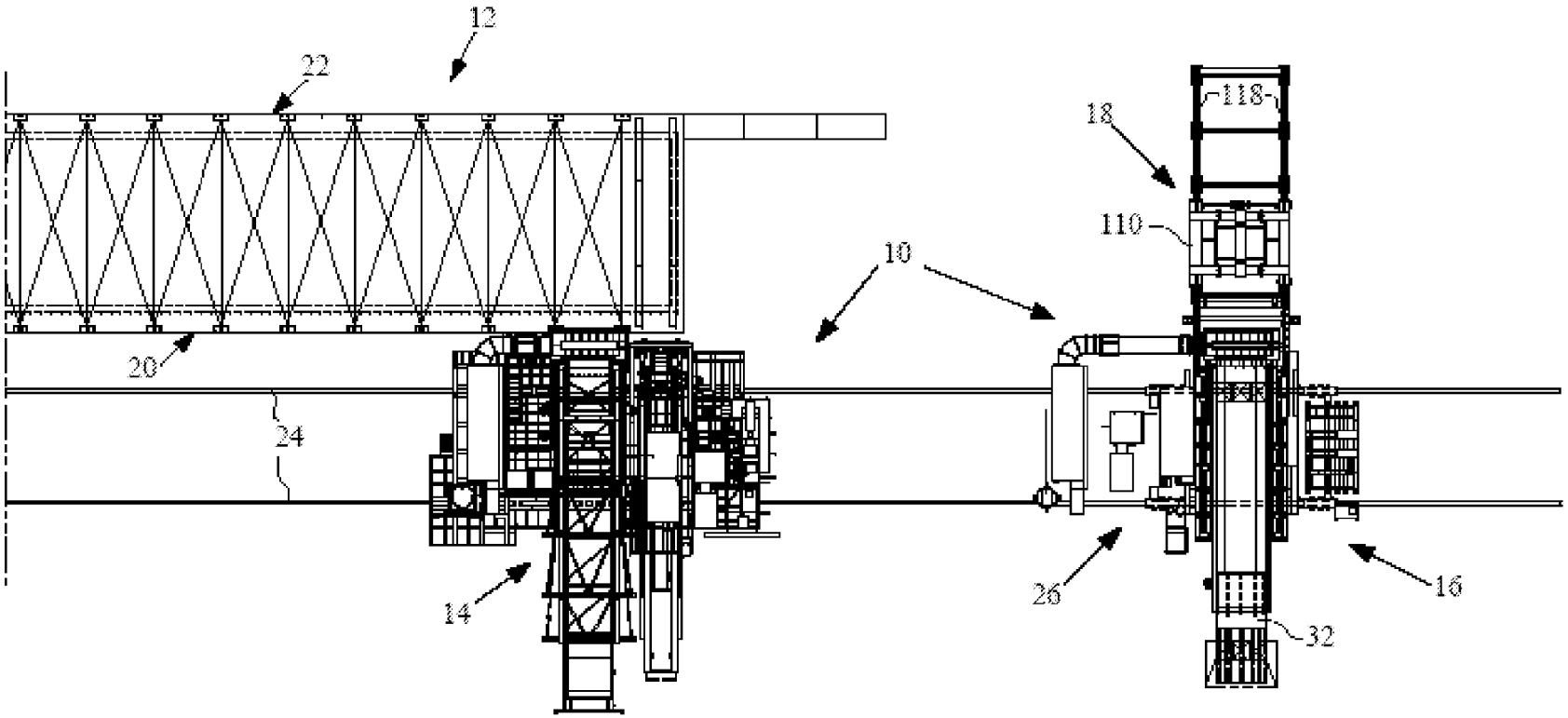
FIG. 1 is a plan view, not to scale, of a charging car, a coal filling station, and a compaction apparatus for a coke oven battery according an embodiment of the disclosure.

As used herein the term "pile-driver-type device" is used to describe the use of a relatively high energy impact per unit of time in a reciprocating manner to compact the coal. Coal dust is generated during the compaction process with the pile-driver-type device due to relatively high impact energy and relatively high speed of the compaction mechanism as air is forced out of the coal. The term "vibratory roller mechanism" means a rolling mechanism that vibrates without imparting impact energy from a pile-driver-type device to the coal as described above. Accordingly, since the energy per unit time of the vibratory roller mechanism is substantially lower than the energy per unit time of the pile-driver-type devices.

As described in more detail below, a high speed system 10 for compacting and charging coal to coke ovens 12 is illustrated in a plan view in FIG. 1. The system includes a movable coal charge car device 14, a coal filling apparatus 16 for filling the coal charge car, and coal compaction apparatus 18 for compacting the coal in the coal charge car device 14. The system 10 is particularly suitable for providing a compacted bed of coal having a depth of from about 75 to about 125 centimeters, a length ranging from about 10 to about 15 meters and a width ranging from about 2 to about 5 meters for charging a horizontal non-recovery coking oven 12.

Figure 2:
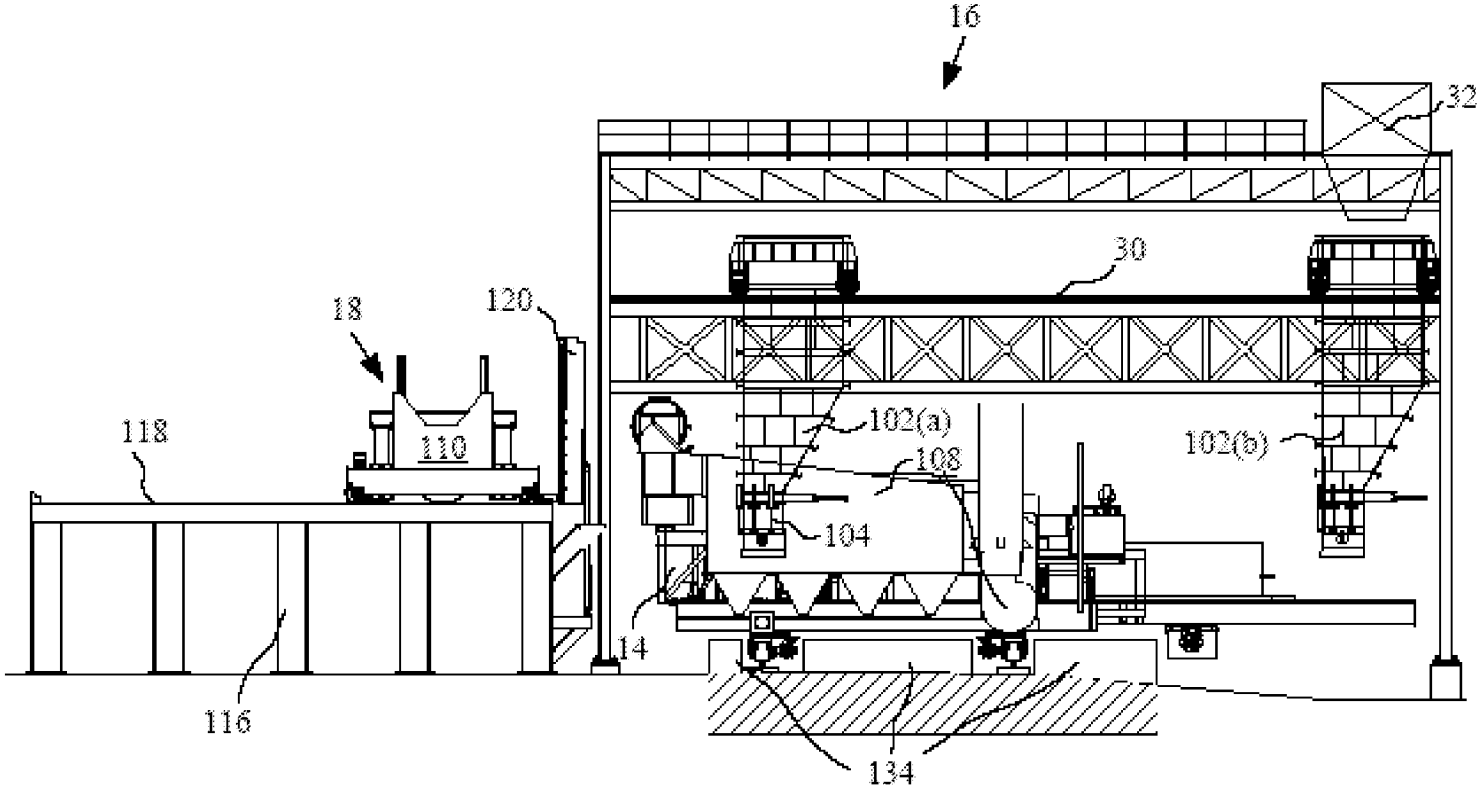
FIG. 2 is a front elevational side view, not to scale, of the coal filling station, compaction apparatus, and charge car device according to an embodiment of the disclosure.
Figure 3:
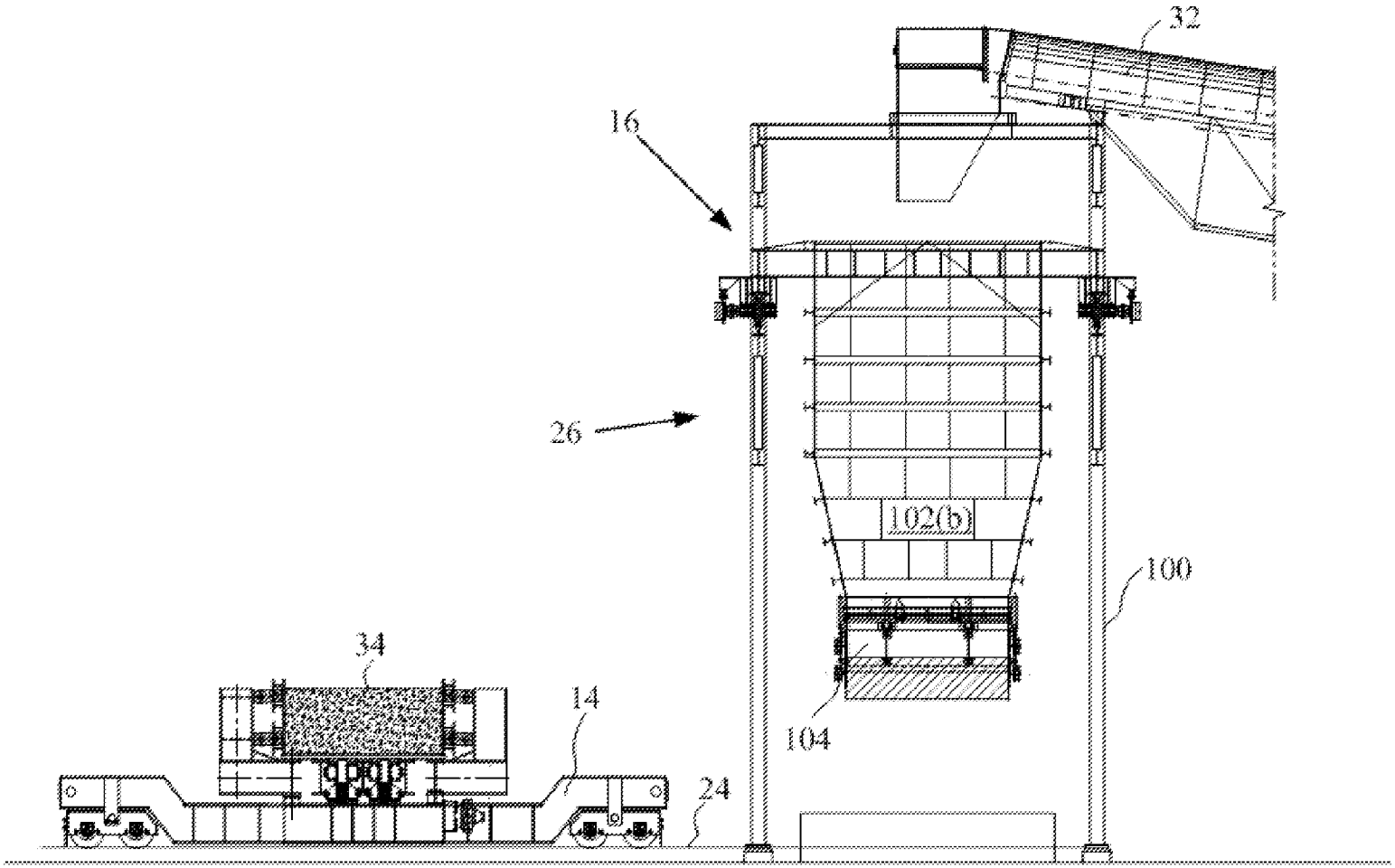
FIG. 3 is side elevational end view, not to scale, of the charge car device and coal filling station according to an embodiment of the disclosure.

With reference to FIGS. 1-3, a typical horizontal non-recovery coke oven battery contains a plurality of side by side coke ovens 12. Each of the coke ovens 12 has a coal charge end 20 and a coke outlet end 22 opposite the charge end 20. A coal coking cycle may range from 24 to 48 hours or more depending on the size of the coal charge to the coke oven 12. At the end of the coking cycle, the coke is pushed out of the oven 12 into a hot car on the coke outlet end 22 of the oven using a discharge ram positioned adjacent the charge end 20 of the oven 12. The discharge ram may be included on the charge car device 14 which may also include a device for removing a charge end oven door prior to pushing the coke out of the oven 12.

As shown in FIG. 1, the charge car device 14 is movable on rails 24 adjacent to an oven 12 to be charged and to a filling station 26 for filling the charge car device 14 with a predetermined amount of coal. The coal filling apparatus 16, described in more detail below, includes a coal bin that is movable on elevated rails 30 orthogonal to rails 24 for movement along a length of the charge car device 14 for filling the coal filling apparatus 16 with a predetermined amount of coal by means of a conveyor 32 (FIG. 3). Compacted coal 34 on the charge car 14 after leaving the filling station is also shown in FIG. 3.

Figure 4:
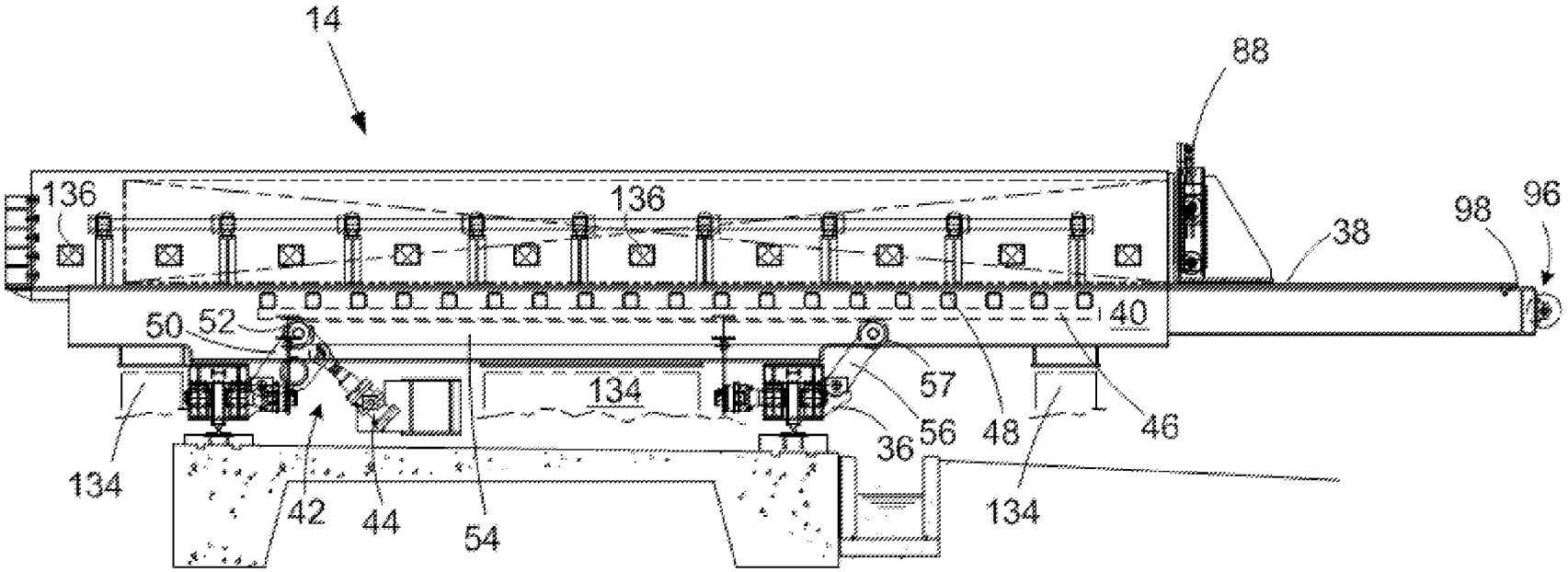
FIG. 4 is an schematic side view, not to scale, of the charge car device according to an embodiment of the disclosure.
Figure 5:
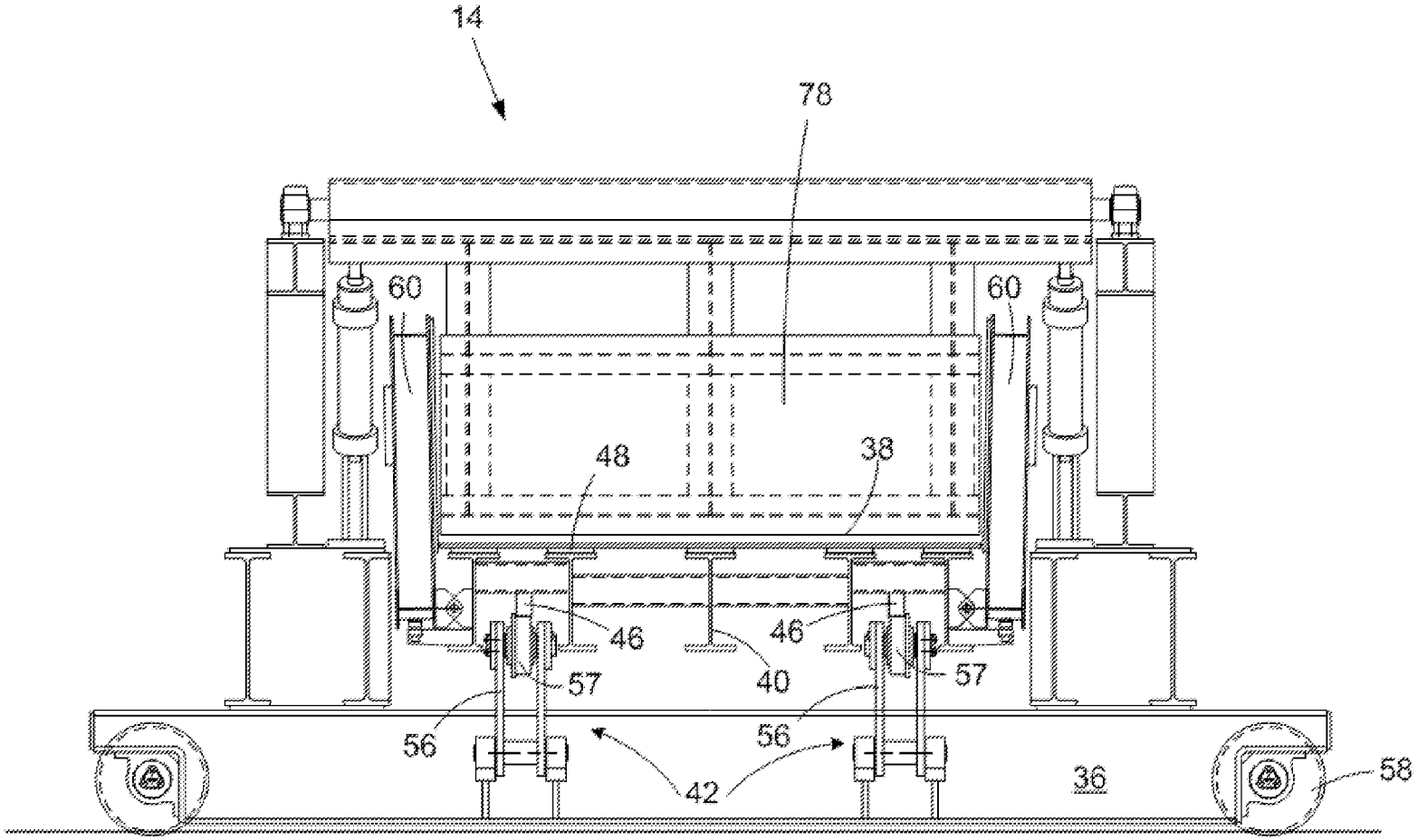
FIG. 5 is an end elevational view, not to scale, of a charge car device according to an embodiment of the disclosure.
Figure 6:
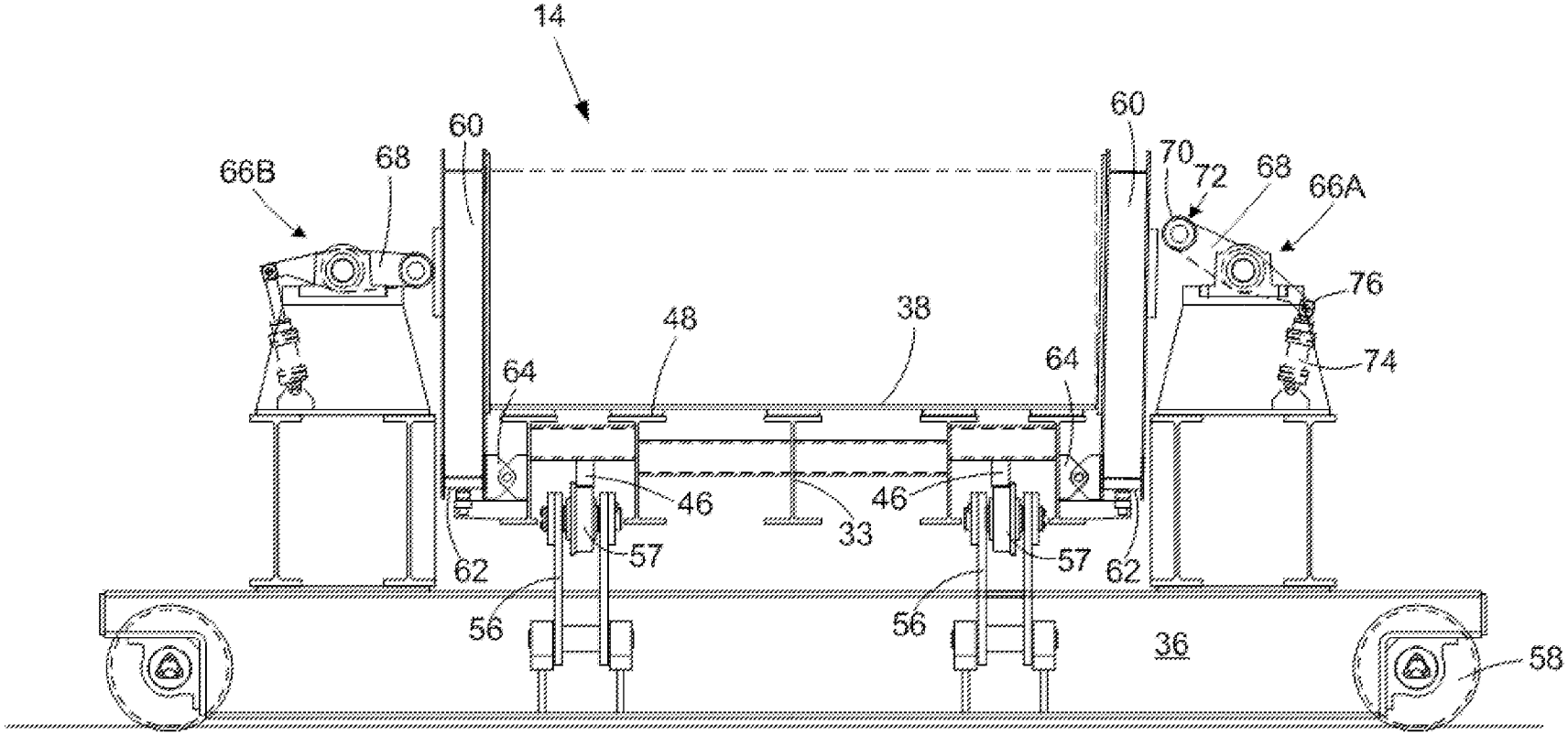
FIG. 6 is an elevational view, not to scale, of the charge car device and side wall locking mechanism according to an embodiment of the disclosure.

With reference now to FIGS. 4-6, various aspects of the components of the system 10 are illustrated and described in more detail. As shown in FIG. 4, the charge car device 14 includes a main support frame 36, a translatable coal transfer plate or spatula 38, a transfer plate support frame 40, and a height adjustment mechanism 42 attached to the frame 40 for positioning a height of the transfer plate 38 relative to an oven floor for an oven 12 being charged with coal. The height adjustment mechanism 42 may also be used to lower the transfer plate 40 onto stationary piers, described in more detail below, for absorbing vibrations during a coal compaction step.

The height adjustment mechanism 42 includes one or more actuators 44 for raising and lowering bearing rails 46 containing bearing rolls 48 or slide plates for translatable movement of the transfer plate 38. The actuator 44 may be selected from a wide variety of mechanisms such as worm gears, chain drives, hydraulic cylinders, and the like. A hydraulic cylinder actuator 44 is particularly suitable for use in the height adjustment mechanism 42 described herein.

Details of portions of the height adjustment mechanism 42 for raising and lowering the transfer plate 38 are provided in FIG. 5. FIG. 5 is an end view of the charge car device 14 showing the height adjustment mechanism 42 attached to the frame 36. The actuator 44 is attached to the frame 36 and to a first pivot arm 50 holding wheel 52. The first pivot arm 50 is mechanically linked, as by a rod or other rigid linking device 54, to a distal pivot arm 56 and wheel 57 that moves in conjunction with the first pivot arm 50 by action of the linking device 54. Each of the first pivot arm 50 and distal pivot arm 56 is pivotally attached to the frame 36.

Upon activation of the actuator 44, the pivot arms 50 and 56 are raised or lowered thereby raising or lowering the rails 46 supporting the transfer plate 38. The wheels 52 enable movement of the rails 46 and transfer plate 38 toward or away from the oven 12 as needed to properly position the charge car device 14 relative to an oven 12 to be charged.

Due to oven height disparities relative to a reference height of the rails 24, the height adjustment mechanism 42 may be used to provide the transfer plate 38 at a desired elevation for translatable movement into the oven 12 to be charged with coal. Variations in oven height typically range from about one to about five inches. Accordingly, the height adjustment mechanism 42 should be capable of moving and holding the transfer plate 38 at an elevation that may vary over a range of from 2.5 centimeters to 15 centimeters from a reference elevation of the transfer plate 38. It will be appreciated that height elevations ranges that may be needed for a particular oven battery may range more than from about 2.5 to about 15 centimeters. In addition to height adjustment of the transfer plate 38, the transfer plate 38, bearing rails 46, and bearing rolls 48 may be telescoped toward the oven 12 for oven charging and away from the oven for movement of the charge car device along rails 24 while clearing other oven structures. A separate actuator may be used to move the rails 46 and transfer plate 38 toward and away from the oven 12.

The frame 36 of the charge car device 14 includes wheels 58 for a positioning the charge car device 14 along rails 24 to adjacent the coal charge end 20 of the oven 12 to be charged with compacted coal. The wheels 58 also enable the charge car device 14 to be positioned in the coal charging station 26 as described in more detail below.

Tiltable side walls 60 are provided along a length of the transfer plate 38. The tiltable side walls 60 may be rotated away from compacted coal on the transfer plate 38 when the transfer plate 38 and compacted coal thereon are being moved into the oven 12. Rotating the tiltable side wall 60 away from the compacted coal may provide reduced friction between the side walls 60 and the compacted coal.

As shown in FIG. 6, the tiltable side walls 60 are pivotally adjacent a first end 62 thereof to wall support members 64 and may be released from contact with the compacted coal or locked against movement as shown and described. Locking mechanisms 66A and 66B may be used in conjunction with the tiltable side walls 60 to prevent the tiltable side walls 60 from moving during a coal compaction process. Each locking mechanism 66A and 66B includes a pivot arm 68 having a roller 70 adjacent a first end 72 thereof and an actuator mechanism 74 adjacent a second end 76 thereof. Locking mechanism 66A is shown in a first unlocked position and locking mechanism 66B is shown in a second locked position in FIG. 6.

Figure 7:
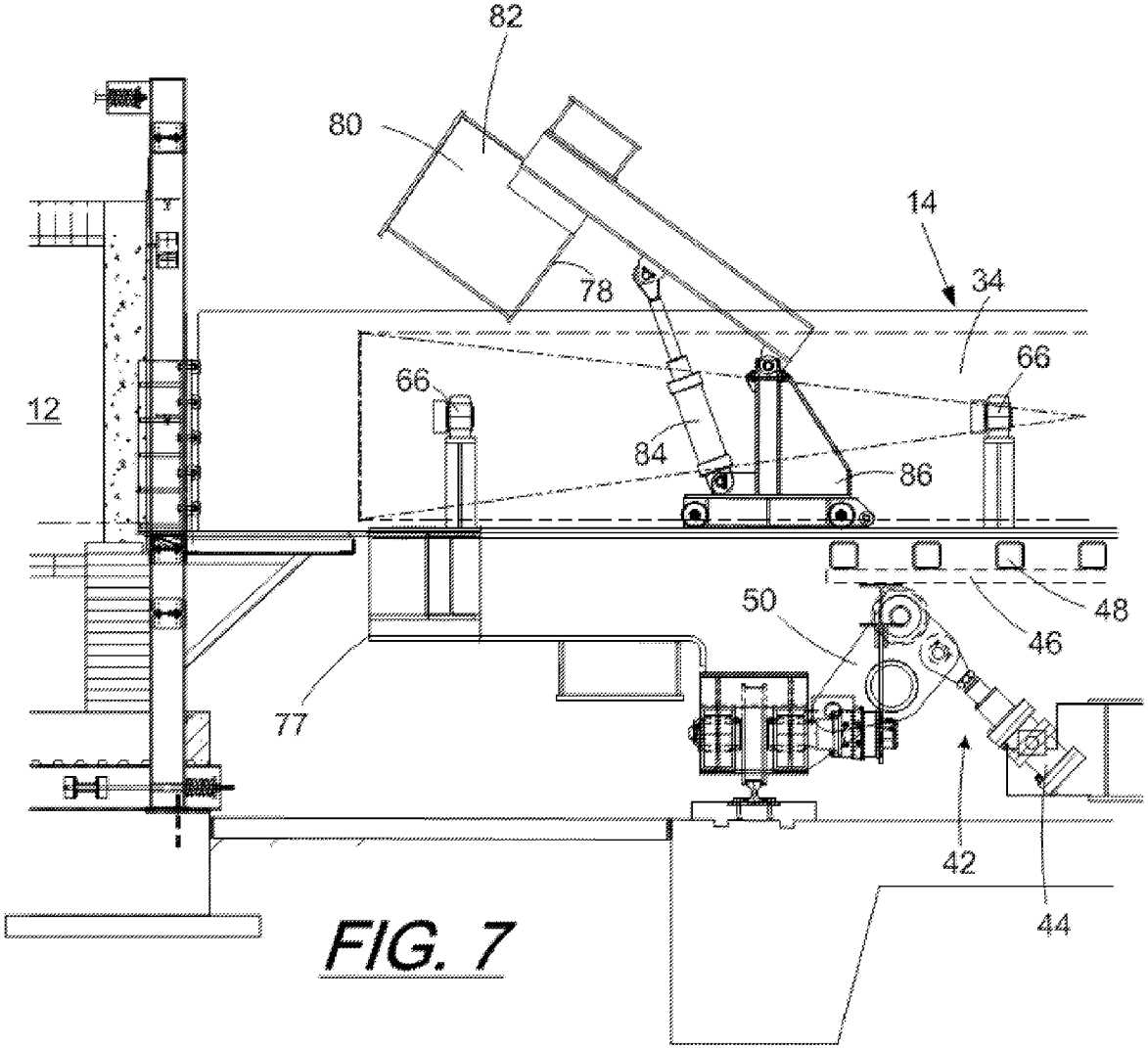
FIG. 7 is an elevational view, not to scale, of a portion of the charge car device and movable end wall for charging a coke oven according to an embodiment of the disclosure.

At least one end 77 (FIG. 7) of the charge car device 14 includes a movable end wall 78 and a ram head 80 attached to opposite sides of a back stop device 82 as shown in more detail in FIG. 7. The back stop device 82 containing the movable end wall 78 and ram head 80 may be rotated in a downward position for loading coal and compacting coal on the transfer plate 38. When the back stop device 82 is rotated in the upward position as shown in FIG. 7, the transfer plate 38 and compacted coal 34 thereon may be translated into the oven 12 to charge the oven.

During the oven charging step, the back stop device 82 (FIG. 7) containing a ram head 80 may be rotated upward, as by actuator 84 so that the compacted coal 34 may be moved into the oven 12. Once the oven 12 is charged with compacted coal 34, the backstop device 82 may be rotated downward, as by actuator 84, and may be moved toward the oven, as by trolley mechanism 86 to place the ram head 80 inside the oven 12 adjacent the compacted coal 34 to hold the compacted coal 34 in the oven 12 while the transfer plate 38 is being withdrawn from the oven 12. After the transfer plate 38 has been withdrawn from the oven 12, the backstop device 82 is rotated upward and is then moved using the trolley mechanism 86 to the position shown in FIG. 7.

Figure 8:
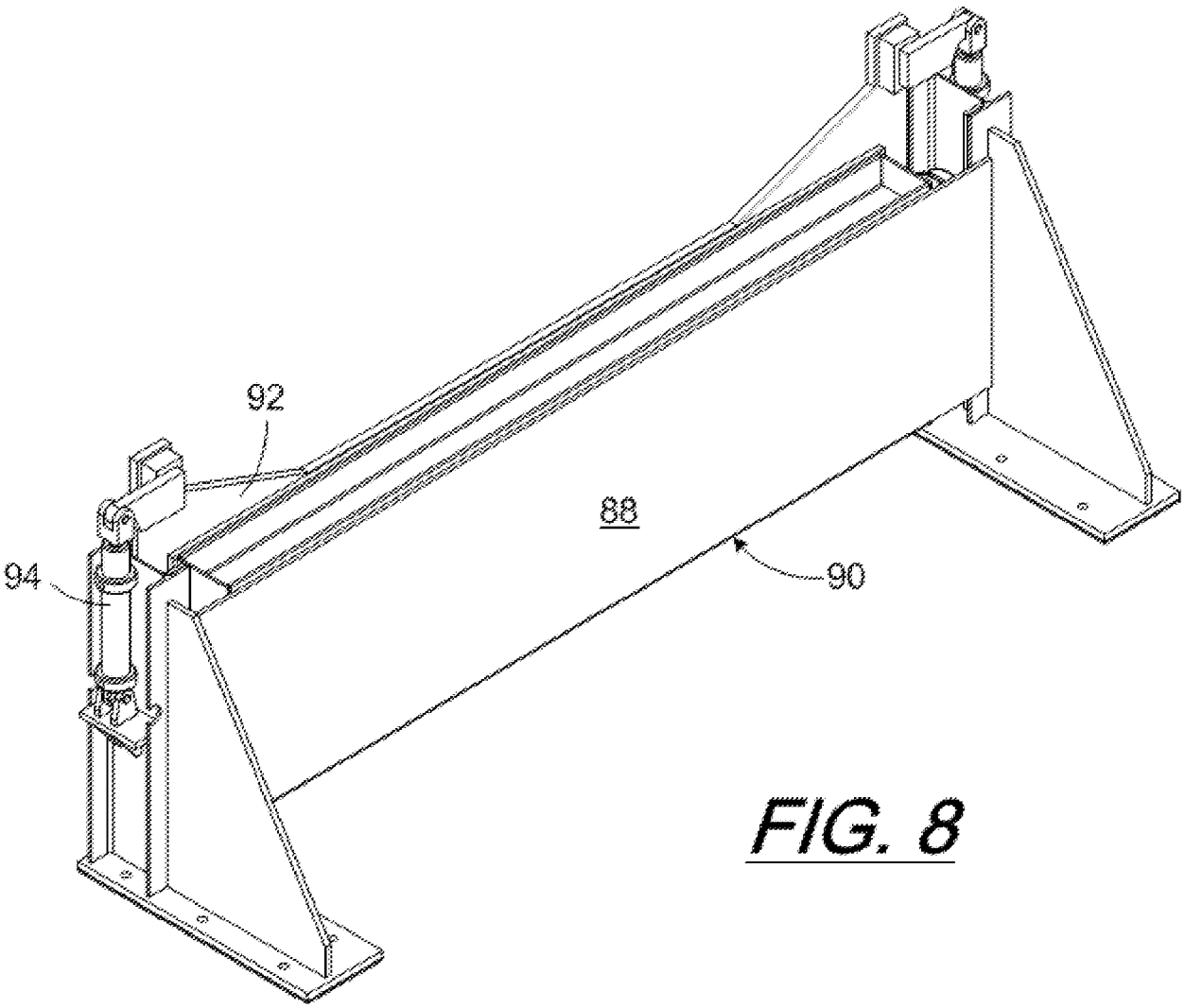
FIG. 8 is a perspective view, not to scale, an adjustable end wall for a charge car device according to the disclosure.

An opposing end of the transfer plate 38 includes an end wall 88 that may be stationary or vertically movable. In one embodiment, the end wall 88 may be adjusted up or down to clear a telescoping chute 104 on the coal filling apparatus 16. Details of the adjustable end wall 88 are illustrated in FIG. 8. The adjustable end wall 88 has a stationary section 90 attached to the frame 36 and a movable section 92 that may be raised and lowered by an actuator mechanism 94.

The transfer plate 38 may be translated into and out of the oven 12 using a combination of a heavy duty, high speed chain and sprocket system 96 with a chain connected to a distal end 98 of the transfer plate 38 for movement of the transfer plate 38 along bearing rolls 48 attached to bearing rails 46 (FIG. 4). During a coal charging operation, the chain and sprocket system 96 moves a portion of the transfer plate 38 into the oven 12 so that the compacted coal 34 may be deposited on a floor surface of the oven when the transfer plate 38 is retracted from the oven 12. The transfer plate 38 has a thickness typically ranging from about 3.5 centimeters to about 8 centimeters and is preferably made of cast steel.

As with the compacted coal charging device described in U.S. Pat. No. 6,290,494 to Barkdoll and U.S. Pat. No. 7,497,930 to Barkdoll et al., the disclosures of which are incorporated herein by reference, the charge car device 14 described herein may optionally include an uncompacted coal chamber for providing an insulating layer of uncompacted coal between the transfer plate 38 and the oven floor as the transfer plate 38 moves into the oven 12. The uncompacted coal layer may insulate the transfer plate 38 from the radiant heat of the oven floor and may provide a relatively smooth, level surface for movement of the transfer plate 38 into and out of oven 12. The weight of the compacted coal 34 and transfer plate 38 is sufficient to compress the uncompacted coal to increase its density above that of uncompacted coal.

With reference again to FIGS. 2-3, the coal filling apparatus 16 for filling the charge car device 14 is illustrated and discussed in more detail. The coal filling apparatus 16 includes an elevated rail structure 100 for rails 30 and a weigh bin 102(*a*) that is movable in a direction substantially orthogonal to rails 24 for filling the charge car device 14 substantially evenly with a predetermined amount of coal.

The rails 30 also enable the weigh bin 102(*b*) to be positioned adjacent a coal storage bin for refilling the weigh bin 102(*b*) with the predetermined amount of coal. The cross conveyor 32 provides flow of coal from the storage bin to the weigh bin 102. The weigh bin 102 is large enough to hold about 50 to 60 metric tons of coal particles.

A telescoping chute and leveling device 104 is provided on a discharge end of the weigh bin 102 to substantially evenly fill the charge car device 14 with uncompacted coal. As the weigh bin 102(*a*) traverses from one end of the charge car device 14 to the other end of the charge car device 14 along rails 30, coal is metered into the charge car device 14 and smoothed to provide a substantially planar surface for the compaction process. The telescoping chute has a profile that provides a "batwing profile" of coal across a width of the transfer plate 38. By "batwing profile" is meant that a depth of uncompacted coal adjacent the side walls 60 is greater than a depth of coal across a substantial portion of the width of the transfer plate 38.

Coal suitable for forming metallurgical coke is typically ground so that at least about 80% has an average size of less than about 3 millimeters as determined by standard screen analysis procedures. The uncompacted coal also has a moisture value ranging from about 6 to about 10 percent by weight and a bulk density ranging from about 640 to about 800 kilograms per cubic meter. As deposited on the transfer plate 38, the uncompacted coal it typically about 50 to 60 percent by volume coal particles and about 40 to about 50 percent by volume voids.

After filling the charge car device 14 with the predetermine amount of coal, typically about 45 to about 55 metric tons of coal, the weigh bin 102(*a*) is moved to position 102(*b*) (FIG. 2) in order to conduct a compacting step for compacting the coal. The compaction device 18 used for compacting the coal includes the compaction apparatus 110 for rapidly compacting the coal in the charge car 14 as illustrated schematically in FIGS. 9A-9B. The compaction device 18 includes a vibratory roller 112 that rolls across uncompacted coal 114 to provide compacted coal 34 so the depth of coal is changed from an initial depth D1 to a compacted depth (D2).

Figure 10:
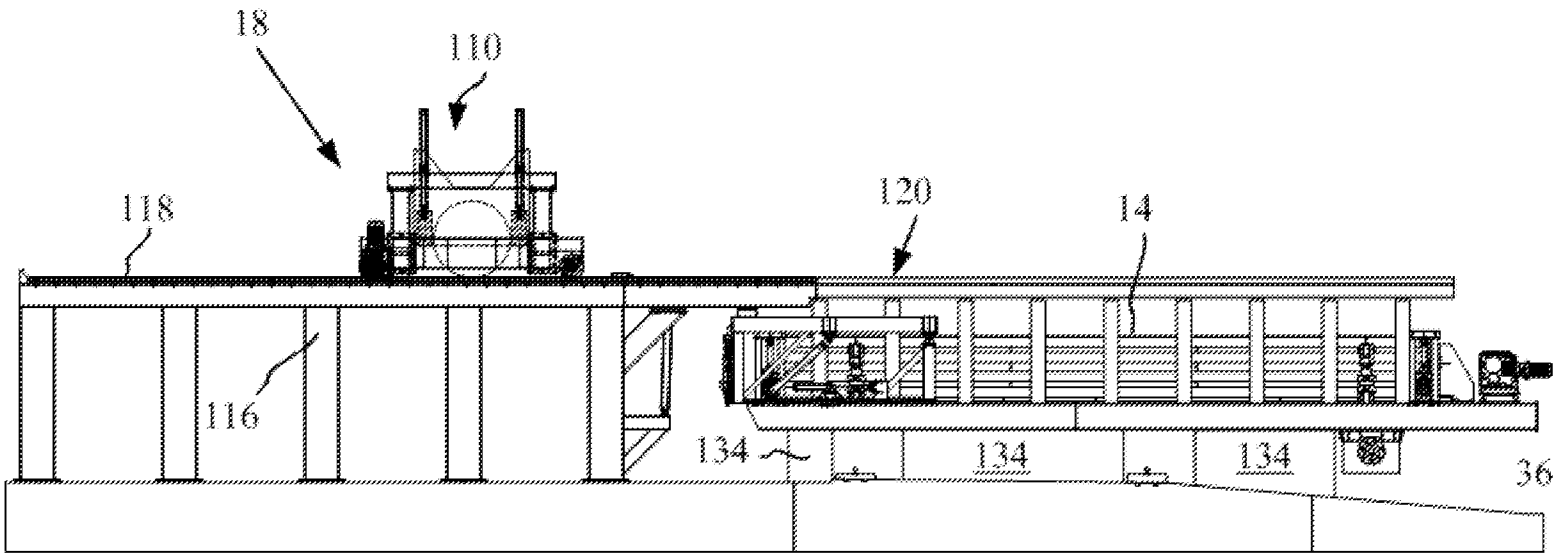
FIG. 10 is a side elevational view, not to scale, of the compaction station and charge car according to the disclosure.

The compaction apparatus 110 is movable on a support system 116 that includes fixed rails 118 and movable rails 120 (FIGS. 2 and 10). Once the charge car 14 is loaded with coal, the movable rails 120 are lowered in a drawbridge-like manner to be adjacent both sides of the charge car 14 so that the compaction apparatus 110 can traverse a length of the charge car 14 on the telescoping rails 120 as illustrated in FIGS. 10 and 12.

Figure 11A:
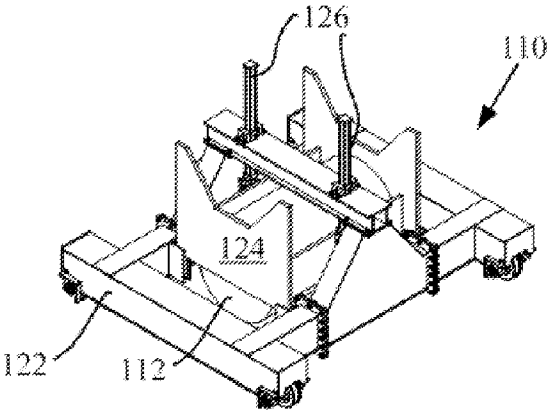
FIGS. 11A-11D are perspective and side views, not to scale, of a compaction device containing the vibratory roller according to the disclosure.
Figure 11B:
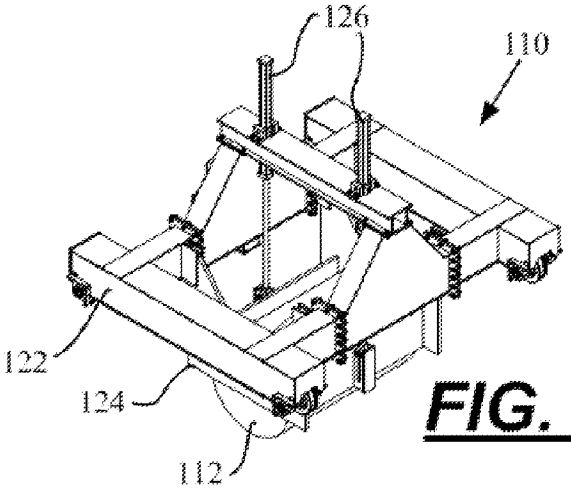
Figure 11C:
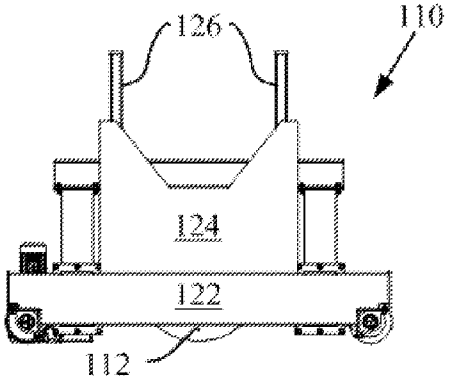
Figure 11D:
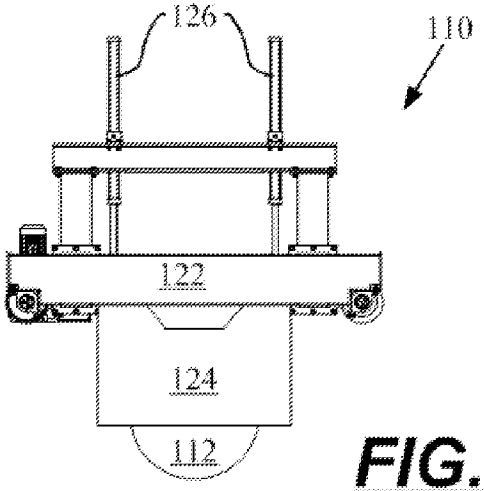

As shown in FIGS. 11A-11D, the compaction apparatus 110 includes a support frame 122 that is movable on the fixed rails 118 and telescoping rails 120. The support frame 122 also includes a roller frame 124 that may be raised as shown in FIGS. 11A and 11C or lowered as shown in FIGS. 11B and 11D by means of actuator devices 126. When the compaction apparatus 110 is in the raised position, the compaction apparatus 110 may be moved over the uncompacted coal 114 in the charge car 14. During the compaction process, the compaction apparatus 110 is in the lowered position for vibratory rolling over the uncompacted coal 114 to compact the coal.

Figure 12:
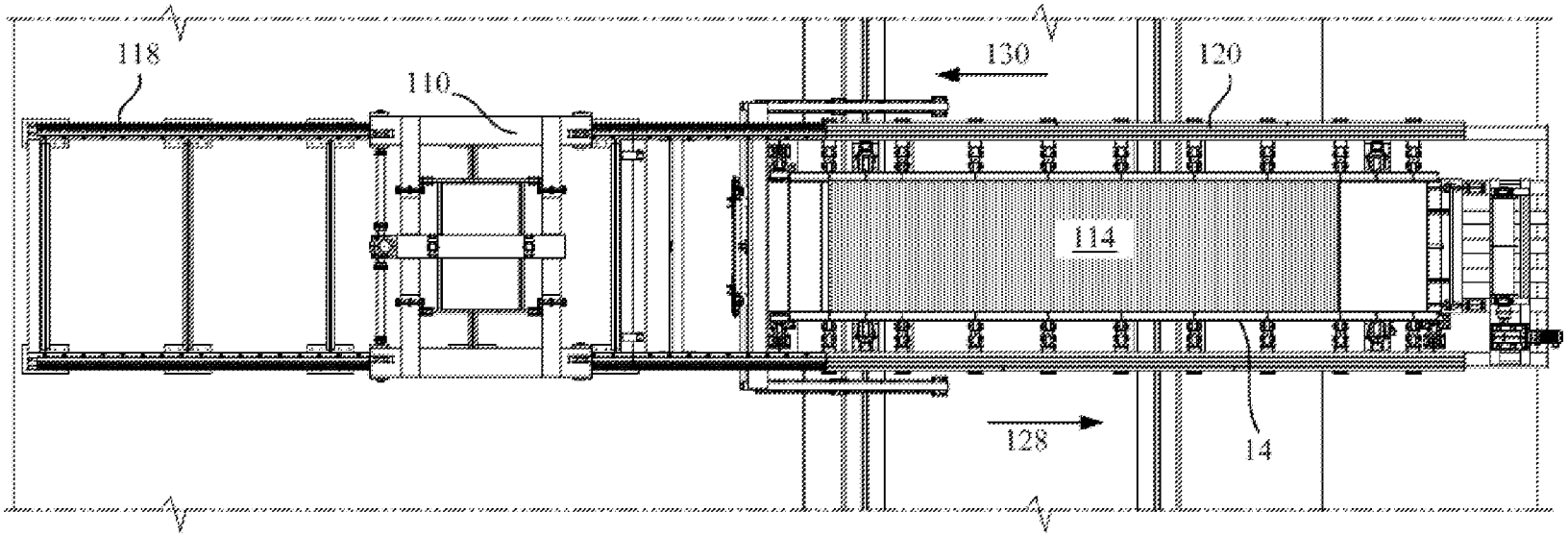
FIG. 12 is plan view, not to scale, of the coal compaction device and charge car according to the disclosure.

A plan view of the compaction apparatus 110 relative to the charge car 14 is illustrated in FIG. 12. The uncompacted coal is disposed in the charge car 14 and the compaction apparatus 110 traverses a length of the charge car 14 during the compaction process. The coal may be compacted in from about 2 to about 6 passes of the compaction apparatus 110. In one embodiment, the compaction apparatus 110 may make a first pass in a direction of arrow 128, with or without vibration while the vibratory roller 112 is in contact with the uncompacted coal 114. The compaction apparatus 110 then makes a second pass in the direction of arrow 130 desirably while the vibratory roller 112 is vibrating to compact the coal. Typically about four total passes are required to compact the coal to the desired bulk density for use in the coke ovens 12 wherein a first pass is conducted without vibration and the subsequent three passes are conducted with vibration.

Figure 9A:
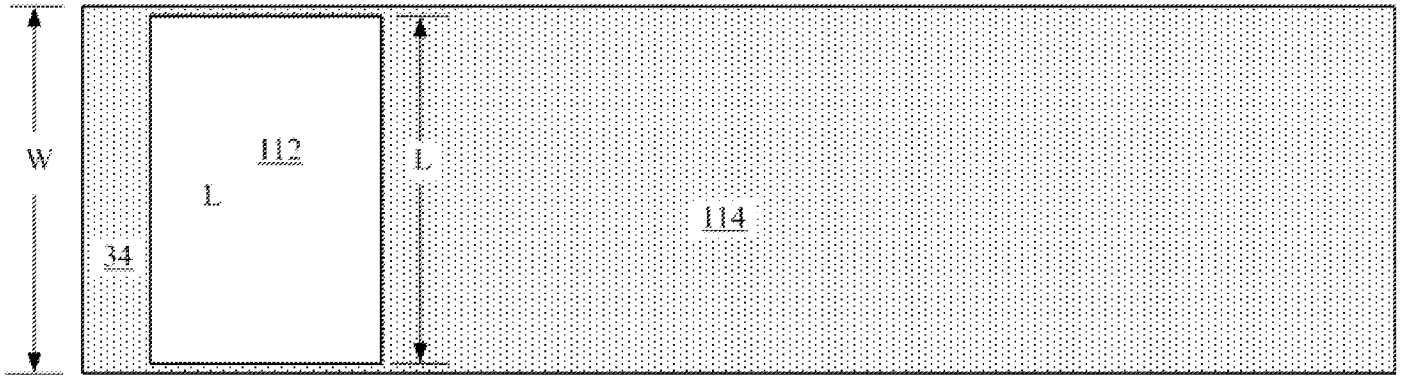
FIGS. 9A-9B are schematic views, not to scale, of a method for compacting coal using a vibratory roller according to an embodiment of the disclosure.
Figure 9B:
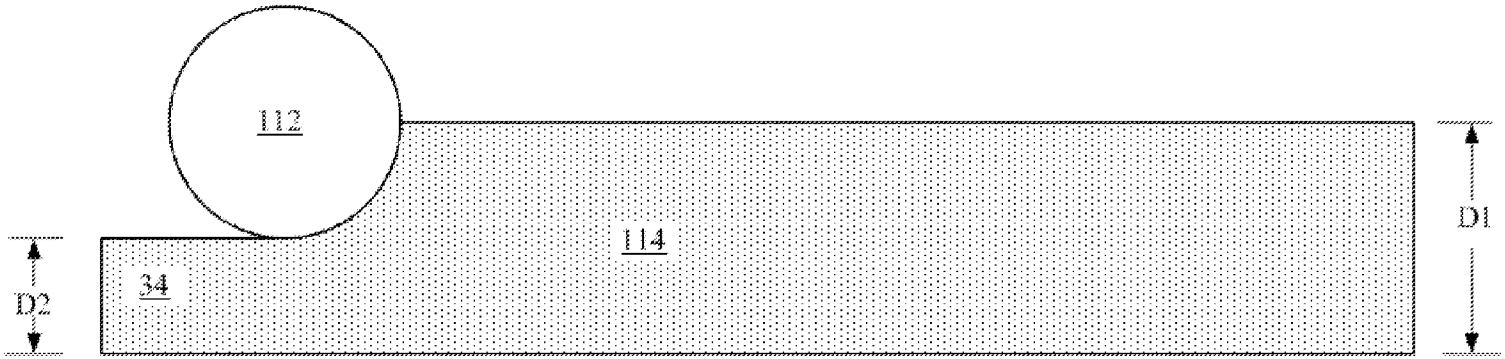

As shown in FIG. 9A, a length L of the vibratory roller 112 may range from about 90 to about 99 percent of a width W of a bed of uncompacted coal 114 to be compacted and a length to diameter ratio ranging from about 1.4:1 to about 2:1. The vibratory roller 112 may have a total weight of from about 25 to about 60 metric tons and traverses the uncompacted coal at a speed ranging from about 0.5 to about 3.0 kilometers per hour during the compaction process. The vibratory roller 112 has a vibrating frequency ranging from about 10 to about 50 Hz with an amplitude ranging from about 1 to about 5 mm and a centrifugal force ranging from about 3000 to about 3600 Newton-meters.

During the compaction process, air from the uncompacted coal 114 may be vented through vents 136 in the side walls 60 of the charge car (FIG. 4). Venting of air or degassing the coal enables faster compaction of the coal 114. The vents 136 may be 30 $cm^2$ wire mesh or perforated screen vents that are spaced apart from one another about 60 centimeters, center to center, along the side walls 60 of the charge car 14. The vents 136 have openings between adjacent wires of from about 75 to about 230 microns in order to minimize the amount of coal entrained in the air vented during the compacting process.

The vents 136 may be vented to the atmosphere, or may be connected in gas flow communication with a vacuum pump and dust collection system 108 (FIG. 2) as described in more detail in U.S. Pat. No. 7,497,930 to Barkdoll et al., the disclosure of which is incorporated herein by reference. During the compaction process, the vacuum pump may apply a vacuum ranging from about 185 to about 280 mm Hg on the probes to remove entrained air from the uncompacted coal bed during the compaction process. Volumetric flow rate of gas during the compaction process for may range from about 50 cubic meters per minute to about 85 cubic meters per minute.

Unlike the use of impact energy to compact the coal, the vibratory roller 112 does not generate a significant amount of dust during the compaction process since the vibratory energy per unit time used is significantly less than an impact energy per unit time required to achieve similar coal bulk densities using the pile-driver-type device. For example, an impact pile driver as described in U.S. Pat. No. 7,497,930 may apply an energy of about 221,208 kilogram-force meter/sec to the coal to provide a bulk density ranging from about 1040 to 1120 kilograms per cubic meter. The same bulk density may be achieved with the vibratory roller 112, according to embodiments of the disclosure with an energy of from about 2 to about 5 kilograms-force meter/sec. Accordingly, a dust collection system is not necessarily required with the vibratory roller 112 while it is desirable to use a dust collection system with a compaction system that uses impact energy to compact the coal. However, using a vacuum pump during the compaction process may be desirable in order to reduce a moisture content of the coal whereby less energy may be required for coking the coal.

In order to reduce shock waves from being transmitted though the wheels 58 and rails 24, support piers 134 (FIG. 4) may be provided to support the charge car 14 in the filling station 26 during the compaction process. Accordingly, the height adjustment mechanism 42 may be actuated to lower the charge car 14 from about 2 to about 6 centimeters so that the transfer plate support frame 40 (FIG. 4) of the charge car 14 is supported mainly by the piers 134 rather than the wheels 58 and frame 36.

The compaction apparatus 18 described above may be sufficient to compact a bed of coal having an initial depth ranging from about 135 to about 145 centimeters to a bulk density of greater than about 800 kilograms per cubic meter in less than about six minutes, and typically in less than about four minutes. The compaction apparatus 18 described herein may provide substantially uniformly compacted coal through the depth of the coal bed. Prior art compaction processes typically provide non-uniform compaction of coal through the depth of the coal bed.

Typical cycle times for filling the charge car 14 with about 52 metric tons of coal and compacting the coal to a target bulk density of about 1040 kilograms per cubic meter are provided in the following table.

TABLE 1

| Step No. | Step Description | Time (seconds) |
|---|---|---|
| 1 | Telescoping Coal Fill Chute Lowered Into Car | 10 |
| 2 | Charge Car Filled With Coal (14 meters long) | 45 |
| 3 | Retract Telescoping Coal Fill Chute | 10 |
| 4 | Move Compaction Apparatus Over Charge Car | 25 |
| 5 | Lower Vibratory Roller Onto Coal Bed | 15 |
| 6 | Move Vibratory Roller Over Coal Bed | 190 |
| 7 | Retract Vibratory Roller From Coal Bed | 15 |
| | Total Time | 310 |

It will be appreciated that the entire process of filling and compacting coal using the vibratory roller and degassing system described above may be achieved in less than about six minutes for the amount of uncompacted coal and the targeted bulk density provided in this example.

Figure 13:
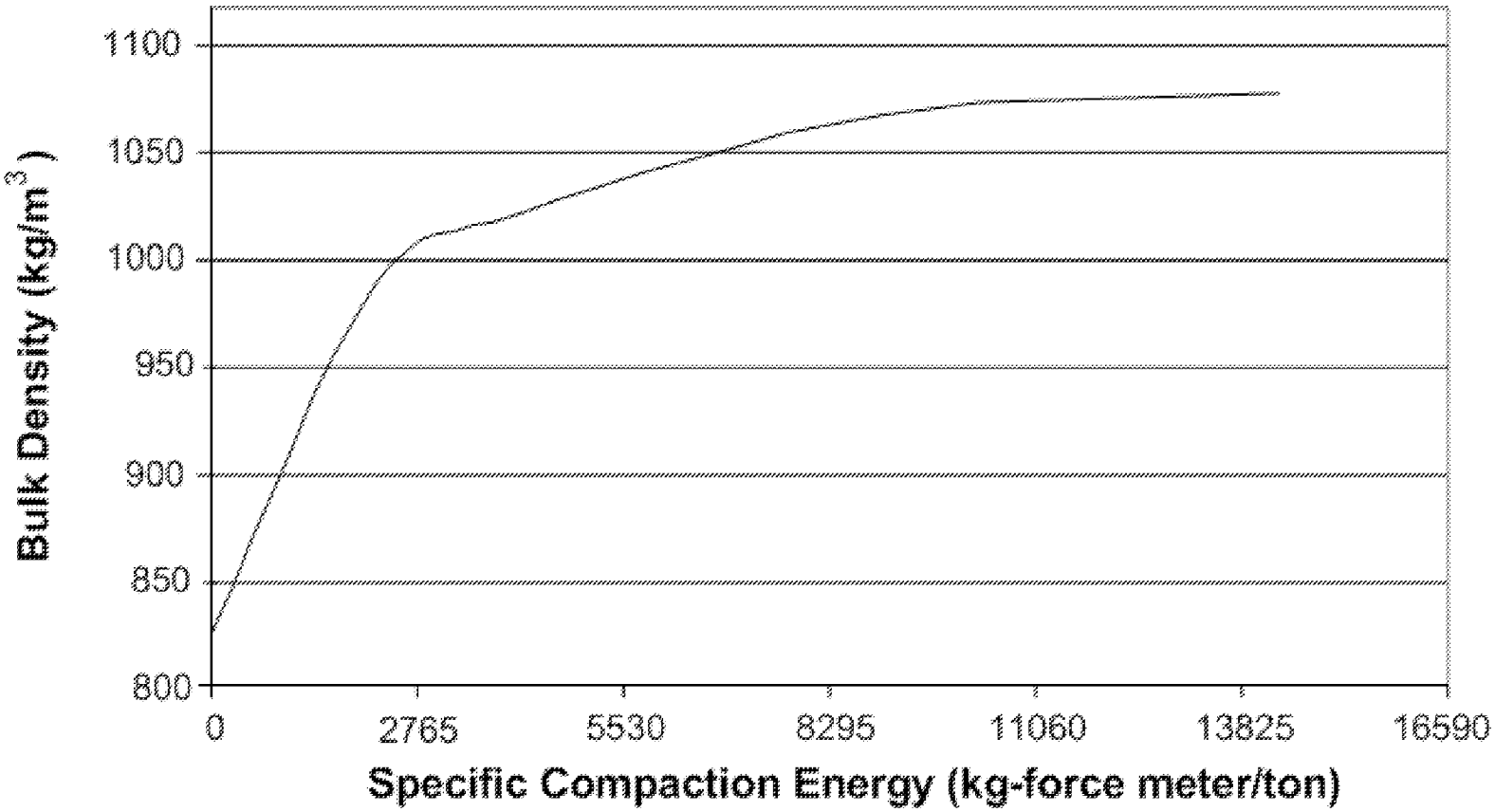
FIG. 13 is a graphical representation of bulk density versus compaction energy for a vibratory roller compaction test according to the disclosure.

In the following example a compaction test on twenty-eight metric tons of coal was conducted to determine the resulting depth and bulk density of the compacted coal after impacting the uncompacted coal bed multiple times while venting air from the coal bed using wall vents as described above to degas the coal during the compaction process. The uncompacted coal bed was placed between concrete barriers on a road bed. Multiple passes of a vibratory roller applying 2200 kilogram-force meter per metric ton of coal was used. The results are shown in the following table and in FIG. 13.

TABLE 2

| Activity | Coal Depth (cm) | Bulk Density ($kg/m^3$) |
|---|---|---|
| Coal between concrete barriers | 123 | 825 |
| After first roller pass | 102 | 995 |
| After second roller pass | 99 | 1021 |
| After third and fourth roller pass | 94 | 1076 |
| After fifth and sixth roller pass | 94 | 1076 |

In the foregoing description, the entire apparatus with the exception of conveyor belts, electrical components and the like may be made of cast or forged steel. Accordingly, robust construction of the apparatus is possible and provides a relatively long lasting apparatus which is suitable for the coke oven environment.

The apparatus and methods described above enable use of less costly coal for metallurgical coke production thereby reducing the overall cost of the coke. Depending on the particular coal source and the level of compaction achieved, a compacted coal charge made according to the invention may include from about 30 to about 60 wt. % non-coking coal. The amount of coke produced by the apparatus of the invention may also be increased from 30 to 40 metric tons up to about 45 to about 55 metric tons as a result of the compaction process. More consistent coal charge physical parameters such as coal charge height, width and depth are also a benefit of the apparatus and methods according to the invention.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A relatively high speed method for increasing the bulk density of coal particles without impacting the coal particles to provide an elongate bed of dry, compacted coal for charging to a coking oven, the method comprising the steps of:

depositing coal particles onto a charging plate external to a coking oven, the charging plate having side walls, and at least one movable end wall to provide an elongate bed of dry, uncompacted coal having an upper surface on the charging plate; and compacting the uncompacted coal by rolling a vibratory cylindrical compactor along a length of the uncompacted coal for a number of passes sufficient to decrease a thickness of the bed of coal to less than about 80 percent of an original thickness of the uncompacted coal, wherein the vibratory cylindrical compactor has a length to diameter ratio ranging from about 1.4:1 to about 2:1 and a compaction energy output ranging from about 2 to about 5 kilograms-force meter per second.

2. The method of claim 1, further comprising degassing the uncompacted coal during the compacting step to provide a dry, compacted coal bed having a bulk density ranging from about 960 to about 1200 kilograms per cubic meter.

3. The method of claim 2, wherein degassing the coal bed is comprised of applying a vacuum source to one or more probes inserted in the uncompacted coal bed.

4. The method of claim 3, wherein the vacuum source provides a vacuum to the uncompacted coal bed ranging from about 185 to about 280 mm of Hg during the degassing step.

5. The method of claim 2, wherein degassing the coal bed comprises venting air at the side walls of the charging plate during the compacting step.

6. The method of claim 1, wherein the coal particles are compacted to the bulk density ranging from about 960 to about 1200 kilograms per cubic meter from an initial bulk density ranging from about 640 to about 800 kilograms per cubic meter in less than 5 passes of the vibratory cylindrical compactor.

7. The method of claim 1, wherein the length of the vibratory cylindrical compactor ranges from about 90 to about 99% of a width of the bed of coal.

8. The method of claim 1, wherein the vibratory cylindrical compactor is operated at a speed ranging from about 0.5 to about 3.0 kilometers per hour.

9. The method of claim 1, wherein the vibratory cylindrical compactor is passed along the length of the uncompacted coal from one to four times to compact the coal.

10. A method for compacting coal, the method comprising:

depositing coal particles onto a charging plate external to a coking oven, the charging plate having an elongate surface for supporting a bed of dry, uncompacted coal; and rolling a vibratory cylindrical compactor along a length of the uncompacted coal, with a compaction energy output ranging from about 2 to about 5 kilograms-force meter per second, for a number of passes sufficient to decrease a thickness of the bed of coal to less than about 80 percent of an original thickness of the uncompacted coal.

11. The method of claim 10, further comprising degassing the uncompacted coal during the rolling to provide a dry, compacted coal bed having a bulk density ranging from about 960 to about 1200 kilograms per cubic meter.

12. The method of claim 11 wherein degassing the coal bed comprises applying a vacuum source or venting air during the rolling.

13. The method of claim 10 wherein rolling the vibratory cylindrical compactor along a length of the uncompacted coal for a number of passes comprises rolling the vibratory cylindrical compactor along a length of the uncompacted coal for less than 5 passes.

14. The method of claim 10 wherein rolling the vibratory cylindrical compactor comprises rolling the compactor over a bed of uncompacted coal having an original thickness between about 135 centimeters and about 145 centimeters, and wherein the coal particles are compacted to a bulk density greater than 800 kilograms per cubic meter.

15. The method of claim 14 wherein rolling the vibratory cylindrical compactor along a length of the uncompacted coal to decrease the thickness of the bed of coal to less than about 80 percent of the original thickness of the uncompacted coal occurs in six minutes or less.

* * * * *